United States Patent [19]

Lewis

[11] 4,332,498

[45] Jun. 1, 1982

[54] SEALANT APPLICATOR

[76] Inventor: William R. Lewis, P.O. Box 82684, Oklahoma City, Okla. 73148

[21] Appl. No.: 207,415

[22] Filed: Nov. 17, 1980

[51] Int. Cl.[3] ..... B43K 5/02

[52] U.S. Cl. ..... 401/188 R; 401/191; 425/87; 222/135

[58] Field of Search ..... 401/5, 188, 191, 195; 425/87; 222/135

[56] References Cited

U.S. PATENT DOCUMENTS

| | | | |
|---|---|---|---|
| 1,584,687 | 5/1926 | Arlt | 401/195 X |
| 1,829,479 | 10/1931 | Elkins | 425/87 |
| 2,618,149 | 11/1952 | Lynn | 401/5 X |
| 2,711,098 | 6/1955 | Ames | 401/6 |
| 3,750,905 | 8/1973 | Wolfrom | 425/87 X |
| 3,964,835 | 6/1976 | Eigenmann | 401/5 X |
| 3,977,797 | 8/1976 | Paterson | 401/188 R X |

*Primary Examiner*—Edward M. Coven
*Attorney, Agent, or Firm*—Dunlap & Codding

[57] ABSTRACT

An improved sealant applicator having a nozzle, a mixer, and a mixer hydraulic motor for dispensing an elastomeric sealant formed by mixing a first component and a second component. A first and a second component conduit are connected to the mixer for delivering the first and the second components to the mixer and a first and a second hydraulic conduit cooperate in delivering hydraulic fluid to the mixer hydraulic motor. The first and the second component conduits and the first and the second hydraulic conduits are retained within a flexible conduit which cooperates to maintain a close proximity between the conduits so heat from the hydraulic conduits heats the components flowing through the component conduits. The various components of the sealant applicator are supported on or connected to a frame and the frame is rollingly supported on wheels. The sealant applicator includes means for rotatingly driving the wheels in a forward and a rearward direction for drivingly moving the frame.

14 Claims, 2 Drawing Figures

SEALANT APPLICATOR

BACKGROUND OF THE INVENTION

Field of the Invention

The present invention relates generally to sealant applicators and, more particularly, but not by way of limitation, to a sealant applicator for dispensing an elastomeric sealant formed by mixing a first and a second component.

BRIEF DESCRIPTION OF THE PREFERRED EMBODIMENT

Figure 1:
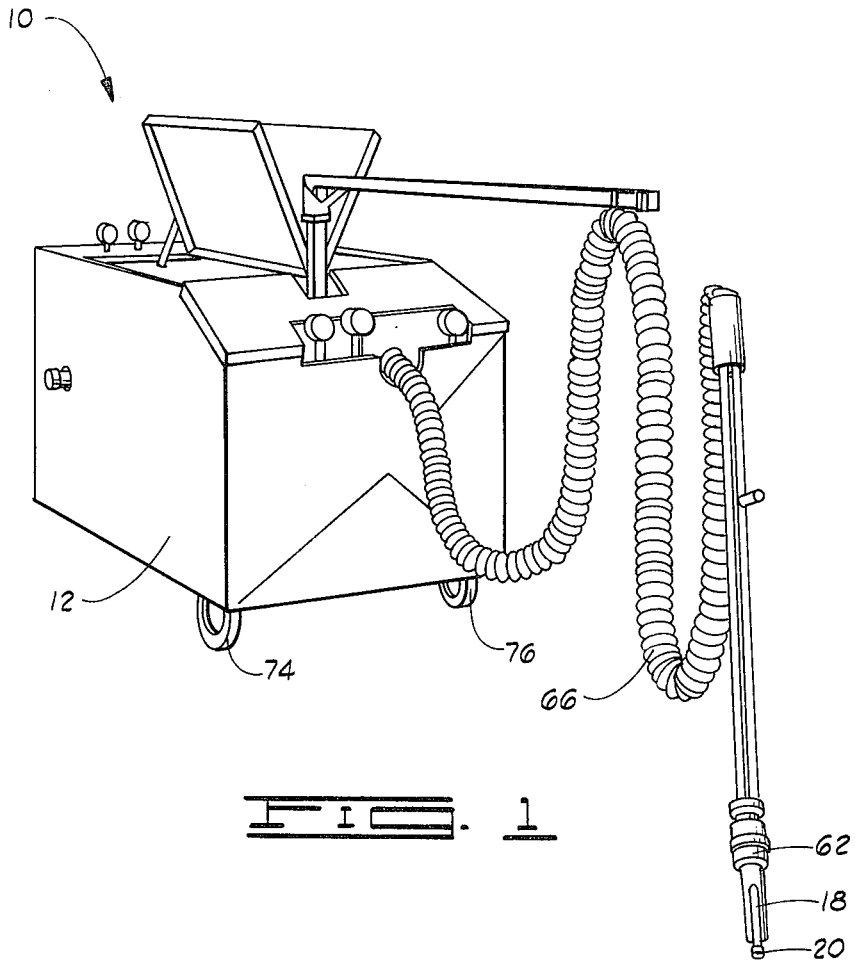
FIG. 1 is a diagrammatic, partial perspective view showing a sealant applicator which is constructed in accordance with the present invention.
Figure 2:
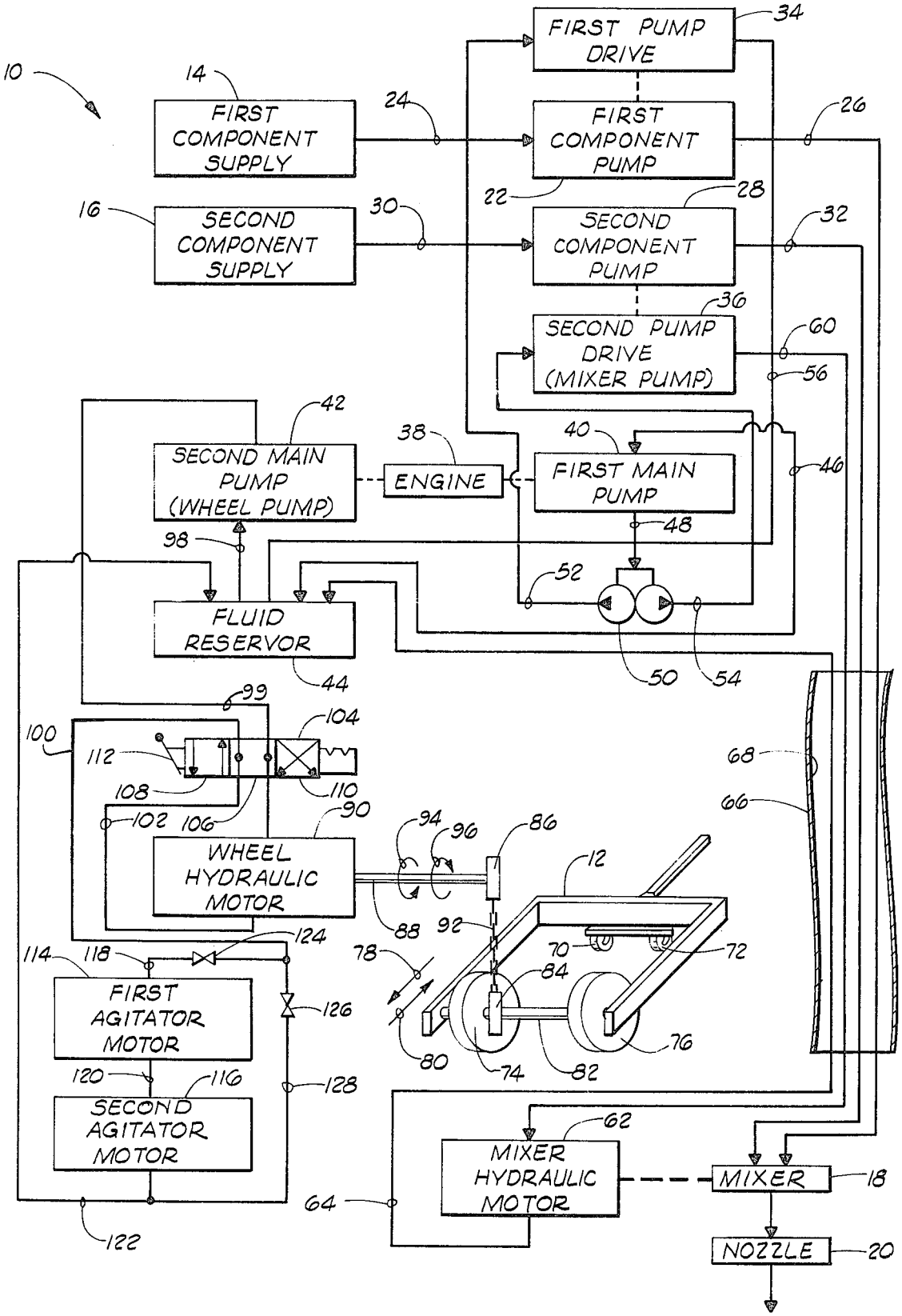
FIG. 2 is a schematic view showing some of the components of the sealant applicator of FIG. 1, particularly showing some of those components for dispensing the two components used to form the elastomeric sealant and some of those components for drivingly moving the sealant applicator in a forward and a reverse direction.

Referring to the drawings in general and to FIGS. 1 and 2 in particular, shown therein and designated by the general reference numeral 10 is a sealant applicator which is constructed in accordance with the present invention. The sealant applicator 10 includes a frame 12, a first component supply 14 which is disposed on the frame 12, a second component supply 16 which is disposed on the frame 12, a mixer 18, and a nozzle 20, the mixer 18 and the nozzle 20 being disposable at a position remote from the frame 12. The first component supply 14 is constructed to store a quantity of a first component and the second component supply 16 is constructed to store a quantity of a second component. The first and the second components are materials which, when mixed together in known ratios, form an elastomeric sealant. Components which can be mixed together to form elastomeric sealants are commercially available from such suppliers as Allied Materials Corporation of Oklahoma City, Okla., and designated as Allied's Product No. 9015M, for example, such elastomeric sealants being extruded into the joints of concrete for sealing against the infiltration of water, for example. With respect to the sealant applicator 10, the first and the second components are passed from the first and the second component supplies 14 and 16 to the mixer 18 where the first and the second components are mixed to form the elastomeric sealant, and then the elastomeric sealant is dispensed through the nozzle 20.

It should be noted that applicators have been constructed in the past consisting of a frame supporting first and second component supplies and including a mixer and a nozzle for mixing the components to form an elastomeric sealant which was dispensed through a nozzle. Thus, the first and the second components, mixers for mixing such components, and nozzles through which the mixed elastomeric sealant can be dispensed all are well known in the art and a detailed description of such is not required herein.

As shown in FIG. 2, the sealant applicator 10 includes a first component pump 22 which is fluidically connected to the first component supply 14 via a conduit 24, and a first component conduit 26 having opposite ends. The first component pump 22 pumps the first component from the first component supply 14 through the conduit 24 and discharges the first component through a pump discharge (not shown in the drawings). One end of the first component conduit 26 is connected to the pump discharge of the first component pump 22 and the opposite end of the first component conduit 26 is connected to the mixer 18, the first component being pumped through the first component conduit 26 to the mixer 18 via the first component pump 22. The first component conduit 26 is constructed of a relatively flexible material and is relatively long so the mixer 18 and nozzle 20 can be positioned remote from the frame 12 during the operation of the sealant applicator 10.

The sealant applicator 10 includes a second component pump 28 which is fluidically connected to the second component supply 16 via a conduit 30, and a second component conduit 32 having opposite ends. The second component pump 28 pumps the second component from the second component supply 16 through the conduit 30 and discharges the second component through a pump discharge (not shown in the drawings). One end of the second component conduit 32 is connected to the pump discharge of the second component pump 28 and the opposite end of the second component conduit 32 is connected to the mixer 18, the second component being pumped through the second component conduit 32 to the mixer 18 via the second component pump 28. The second component conduit 32 is constructed of a relatively flexible material and is relatively long so the mixer 18 and nozzle 20 can be positioned remote from the frame 12 during the operation of the sealant applicator 10.

A first pump drive 34 is mechanically connected to the first component pump 22 for driving the first component pump 22 to pump the first component. A second pump drive 36 is mechanically connected to the second component pump 28 for driving the second component pump 28 to pump the second component. As indicated in FIG. 2, the second pump drive is sometimes referred to herein as the "mixer pump", for reasons which will be made more apparent below.

The sealant applicator 10 includes an engine 38 which is mechanically connected to a first main pump 40 and to a second main pump 42, the second main pump 42 sometimes being referred to herein as the "wheel pump" for reasons which will be made more apparent below. In one preferred embodiment, the engine 38 is a gasoline driven engine and, in this embodiment, an eight horsepower gasoline driven engine was found to provide adequate horsepower. The sealant applicator 10 also includes a fluid reservoir 44 which is constructed to retain or store a quantity of hydraulic fluid.

The first main pump 40 is fluidically connected to the fluid reservoir 44 via a conduit 46, the first main pump 40 pumping hydraulic fluid from the fluid reservoir 44 through the conduit 46 and discharging the hydraulic fluid through a conduit 48. A flow divider valve 50 is interposed in the conduit 48, the flow divider valve 50 dividing the received hydraulic fluid provided by the first main pump 40 and discharging one-half of the received hydraulic fluid out through a conduit 52 and the other one-half of the received hydraulic fluid out through a conduit 54.

The conduit 52 is connected to the first pump drive 34 and thus the first main pump 40 pumps hydraulic fluid from the fluid reservoir 44 through the conduits 46, 48, and 52 to the first pump drive 34. The first pump drive 34 discharges the hydraulic fluid through a conduit 56 which is connected to the fluid reservoir 44, the discharge of the first pump drive 34 thus being in fluidic communication with the fluid reservoir 44 via the conduit 56.

The conduit 54 is connected to the second pump drive 36 and thus the first main pump 40 pumps hydraulic fluid from the reservoir 44 through the conduits 46, 48, and 54 to the second pump drive 36. The second pump drive 36 discharges the hydraulic fluid through a first hydraulic conduit 60. The first hydraulic conduit 60 has opposite ends with one end being connected to a mixer hydraulic motor 62 and the opposite end being connected to the second pump drive 36. The mixer hydraulic motor 62 is mechanically connected to the mixer 18 for driving the mixer 18, the mixer hydraulic motor 62 discharging the hydraulic fluid through a second hydraulic conduit 64. The second hydraulic conduit 64 has opposite ends with one end being connected to the mixer hydraulic motor 62 and the opposite end being connected to the fluid reservoir 44. Thus, hydraulic fluid is delivered to the mixer hydraulic motor 62 through the first hydraulic conduit 60 and the second hydraulic conduit 64 receives the hydraulic fluid from the mixer hydraulic motor 62 and delivers the received hydraulic fluid to the fluid reservoir 44. Since the second pump drive 36 delivers the hydraulic fluid to the mixer hydraulic motor 62 for driving the mixer hydraulic motor 62 so the mixer hydraulic motor 62 can drive the mixer 18, the second pump drive 36 is sometimes referred to herein as the "mixer pump" as mentioned before. The first and the second hydraulic conduits 60 and 64 are each constructed of a relatively flexible material and each is relatively long so the mixer 18 and nozzle 20 can be positioned remote from the frame 12 during the operation of the sealant applicator 10, the mixer hydraulic motor 62 also being remotely positionable with respect to the frame 12.

The first and the second component conduits 26 and 32 and the first and the second hydraulic conduits 60 and 64 each extend a distance from the frame 12 and the mixer hydraulic motor 62, the mixer 18 and the nozzle 20 are each supported on the respective ends of the conduits 26, 32, 60, and 64 remote from the frame 12. The sealant applicator 10 includes a flexible tube 66 having an opening 68 extending therethrough and intersecting the opposite ends thereof. A substantial portion of length of each of the conduits 26, 32, 60, and 64 extends through the opening 68 in the flexible tube 66. The opening 68 is sized to maintain the conduits 26, 32, 60, and 64 in close proximity during the operation of the sealant applicator 10.

The first and the second components are combinable to form the elastomeric sealant as described before and it is important to maintain the components heated during the operation of the sealant applicator 10 so the components are flowable. The hydraulic fluid flowing through the first and the second hydraulic conduits 60 and 62 is relatively warm and thus heat is emitted from the first and the second hydraulic conduits 60 and 64. The use of the flexible tube 66 to maintain the conduits 26, 32, 60, and 64 in close proximity during the operation of the sealant applicator 10 permits the heat from the first and the second hydraulic conduits 60 and 64 to heat the first and the second components flowing through the first and the second component conduits 26 and 32 thereby cooperating to maintain the flowability of the first and the second components.

The frame 12 is rollingly supported on a pair of rear wheels 70 and 72 which are pivotally connected to the frame 12 to permit the frame 12 to be manually steered via a handle 74, the connection of the rear wheels 70 and 72 to the frame not being shown in the drawings. Further, the frame 12 is rollingly supported on a first and a second wheel 74 and 76, respectively. The wheels 70, 72, 74, and 76 cooperate to rollingly support the frame 12 so the frame 12 can be moved in a forward direction 78 and in a rearward direction 80.

A wheel shaft 82 is journally connected to the frame 12 generally near the rear of the frame 12. More particularly, the wheel shaft 82 has opposite ends, one end of the wheel shaft 82 being journally connected to one portion of the frame 12 and the opposite end of the wheel shaft 82 being journally connected to another portion of the frame 12, as diagrammatically indicated in FIG. 2. The wheel shaft 82 extends generally between the opposite sides of the frame 12.

The wheel shaft 82 extends through a central portion of the first wheel 74 and the first wheel 74 is connected to the wheel shaft 82. The wheel shaft 82 extends through a central portion of the second wheel 76 and the second wheel 76 is connected to the wheel shaft 82.

The wheel shaft 82 extends through a central portion of a first sprocket 84 and the first sprocket 84 is connected to the wheel shaft 82. A second sprocket 86 is connected to an output shaft 88 of a wheel hydraulic motor 90. The second sprocket 86 generally is aligned with the first sprocket 84, and the first and the second sprockets 84 and 86 are drivingly connected with a drive chain 92.

The wheel hydraulic motor 90 is constructed to rotatingly drive the output shaft 88 in a forward direction of rotation 94 in a forward driven condition of the wheel hydraulic motor 90. The wheel hydraulic motor 90 is constructed to rotatingly drive the output shaft 88 in a reverse direction of rotation 96 in a reverse driven condition of the wheel hydraulic motor 90.

The second main pump or wheel pump 42 is fluidically connected to the fluid reservoir 44 via a conduit 98. The wheel pump 42 is constructed to pump hydraulic fluid from the fluid reservoir 44 through the conduit 98, the hydraulic fluid being discharged from the wheel pump 42 through a conduit 99. A conduit 100 is provided for passing the hydraulic fluid from the wheel hydraulic motor 90. A conduit 101 is connected to one side of the wheel hydraulic motor 90 and a conduit 102 is connected to the opposite side of the wheel hydraulic motor 90. The wheel hydraulic motor 90 is constructed to drivingly rotate the output shaft 88 in the forward direction 94 when receiving hydraulic fluid through the conduit 101, the hydraulic fluid being passed from the wheel hydraulic motor 90 through the conduit 102 in this condition of the wheel hydraulic motor 90 which is sometimes referred to herein as the "forward driven condition". The wheel hydraulic motor 90 is constructed to drivingly rotate the output shaft 88 in the reverse direction 96 when receiving hydraulic fluid through the conduit 102, the hydraulic fluid being passed from the wheel hydraulic motor 90 through the conduit 101 in this condition of the wheel hydraulic motor 90 which is sometimes referred to herein as the "reverse driven condition".

A directional, three position valve 104 is interposed between the conduits 99 and 101 and the conduits 100 and 102, the valve 104 being interposed generally between the wheel pump 42 and the wheel hydraulic motor 90. The valve 104 has three positions, a first position 106, a second position 108, and a third position 110. The valve 104 is selectively and manually positionable in the three positions 106, 108, and 110, by a valve handle 112.

When the valve 104 is positioned in the first position 106, hydraulic fluid cannot flow through the valve 104 and thus fluidic communication between the wheel pump 42 and the wheel hydraulic motor 90 is interrupted. Thus, in the first position 106 of the valve 104, the wheel hydraulic motor 90 does not rotatingly drive the output shaft 96.

When the valve 104 is positioned in the second position 108, fluidic communication is established between the conduits 99 and 101 and between the conduits 100 and 102, and thus the wheel pump 42 pumps hydraulic fluid to the wheel hydraulic motor 90 through the conduits 99 and 101, the hydraulic fluid being passed from the wheel hydraulic motor 90 through the conduits 102 and 100 in the second position 108 of the valve 104 to condition the wheel hydraulic motor 90 in the forward condition for rotatingly driving the output shaft 88 in the forward direction 94.

When the valve 104 is positioned in the third position 110, fluidic communication is established between the conduits 99 and 102 and between the conduits 100 and 101, and thus the wheel pump 42 pumps hydraulic fluid to the wheel hydraulic motor 90 through the conduits 99 and 102, the hydraulic fluid being passed from the wheel hydraulic motor 90 through the conduits 101 and 100 in the third position 110 of the valve 104 to condition the wheel hydraulic motor 90 in the reverse condition for rotatingly driving the output shaft 88 in the reverse direction 96.

A first agitator motor 114 drives an agitator (not shown in the drawings) which is disposed in the first component supply 14, the agitator being used to agitate the first component in the first component supply 14 during the operation of the sealant apparatus 10. A second agitator motor 116 drives an agitator (not shown in the drawings) which is disposed in the second component supply 16, the agitator being used to agitate the first component in the second component supply 16 during the operation of the sealant apparatus 10. Agitators have been disposed in the component supplies of prior sealant applications and a detailed description of the construction and operation of such devices is not required herein.

The first agitator motor 114 is connected to the conduit 100 via a conduit 118 so the hydraulic fluid being discharged from the wheel hydraulic motor 90 is passed to the first agitator motor 114 via the conduits 100 and 118. The hydraulic fluid being passed from the first agitator motor 114 through a conduit 120 to the second agitator motor 116. The hydraulic fluid is passed from the second agitator motor 116 through a conduit 122 to the fluid reservoir 44.

The first and the second component supplies 14 and 16, the pump drives 34 and 36, the pumps 22, 28, 40, and 42, the engine 38, the fluid reservoir 44, the wheel hydraulic motor 90, the valve 104 and the motors 114 and 116 are each supported on the frame 12.

A valve 124 is interposed in the conduit 118 and a valve 126 is interposed in a conduit 128 which is connected generally around the agitator motors 114 and 116. The valves 124 and 126 permit the agitator motors 114 and 116 to be bypassed if it is not desired to drive the agitators during certain times.

In operation, the first and the second component pumps 22 and 28 function to pump the first and the second components, respectively, from the respective first and second component supplies 14 and 16 to the mixer 18. The mixer 18 mixes the received first and second components to form the elastomeric sealant which is dispensed through the nozzle 20. The mixer 18 is driven by the mixer hydraulic motor 22 which is connected to the mixer pump 36 and the fluid reservoir 44 via the conduits 60 and 64, respectively. The conduits 26, 32, 60, and 64 each extend from the frame 12 through the opening 68 in the flexible tube 66, the flexible tube 66 functioning to maintain the conduits 26, 32, 60, and 64 in close proximity so the heat generated from the hydraulic fluid in the conduits 60 and 64 heats the first and the second components flowing through the conduits 26 and 32, respectively, to maintain the flowability of the first and the second components.

The first and the second component pumps 22 and 28 are driven by the pump drives 34 and 36, respectively, which are driven by the first main pump. The second main pump or wheel pump 42 drives the wheel hydraulic motor 90 and the agitator motors 114 and 116.

When the valve 104 is positioned in the second position 112, the wheel hydraulic motor 90 is conditioned in the forward condition to rotatingly drive the output shaft 88 in the forward direction 94. The rotation of the output shaft 88 in the forward direction 94 causes the wheel shaft 82 to be rotated to rotatingly drive the first and second wheels 74 and 76 to rollingly move the frame 12 in the forward direction 78 via the interconnection between the wheel hydraulic motor 90 and the wheel shaft 92 provided by the sprockets 84 and 86 and the drive chain 92.

When the valve 104 is positioned in the third position 110, the wheel hydraulic motor 90 is conditioned in the reverse condition to rotatingly drive the output shaft 88 in the reverse direction 96. The rotation of the output shaft 88 in the reverse direction 96 causes the wheel shaft 82 to be rotated to rotatingly drive the first and the second wheels 74 and 76 to rollingly move the frame 12 in the reverse or forward direction 80 via the interconnection between the wheel hydraulic motor 90 and the wheel shaft 82 provided by the sprockets 84 and 86 and the drive chain 92.

Changes may be made in the construction and the operation of the various components and assemblies described herein without departing from the spirit and the scope of the invention as defined in the following claims.

I claim:

1. A sealant applicator for applying an elastomeric sealant made by mixing a first and a second component, comprising:

a frame;

a first component supply for storing a quantity of the first component being disposed on the frame;

a second component supply for storing a quantity of the second component being disposed on the frame;

a first component pump fluidically connected to the first component supply for receiving the first component and for pumping the first component out a pump discharge;

a second component pump fluidically connected to the second component supply for receiving the second component and for pumping the second component out a pump discharge;

a first component conduit having opposite ends with one end being connected to the pump discharge of the first component pump, the first component pump pumping the first component from the first component supply through the first component conduit;

a second component conduit having opposite ends with one end being connected to the pump discharge of the second component pump, the second component pump pumping the second component from the second component supply through the second component conduit;

a mixer, the end of the first component conduit opposite the end connected to the first component pump being connected to the mixer and the end of the second component conduit opposite the end connected to the second component pump being connected to the mixer, the mixer receiving the first and the second components flowing through the first and the second component conduits and mixing the first and the second components to form the elastomeric sealant when being driven;

a nozzle connected to the mixer for receiving the elastomeric sealant and for dispensing the received elastomeric sealant;

a mixer hydraulic motor connected to the mixer for driving the mixer;

a first hydraulic conduit having opposite ends with one end being connected to the mixer hydraulic motor for delivering hydraulic fluid to the mixer hydraulic motor;

a second hydraulic conduit having opposite ends with one end being connected to the mixer hydraulic motor for receiving hydraulic fluid from the mixer hydraulic motor, the first and the second component conduits and the first and the second hydraulic conduits each extending a distance from the frame for disposing the mixer, the mixer hydraulic motor and the nozzle at a position remote from the frame;

a fluid reservoir for storing a quantity of hydraulic fluid, the end of the second hydraulic conduit opposite the end connected to the mixer hydraulic motor being connected to the fluid reservoir;

a mixer pump connected to the fluid reservoir and to the end of the first hydraulic conduit opposite the end connected to the mixer hydraulic motor for pumping hydraulic fluid through the first hydraulic conduit to the mixer hydraulic motor;

a flexible tube having an opening extending therethrough, a substantial portion of the first and the second component conduits and the first and second hydraulic conduits extending through the opening in the flexible conduit, the flexible conduit maintaining the first and the second component conduits and the first and the second hydraulic conduits in close proximity during the operation of the sealant applicator so the heat from the first and the second hydraulic conduits heats the first and the second components flowing through the first and the second component conduits;

a wheel shaft, having opposite ends;

means for journally connecting the wheel shaft to the frame;

a first wheel connected to the wheel shaft generally near one end of the wheel shaft;

a second wheel connected to the wheel shaft generally near the other end of the wheel shaft;

a wheel hydraulic motor supported on the frame having an output shaft, the wheel hydraulic motor rotatingly driving the output shaft in a forward direction in forward driven condition and rotating driving the output shaft in a reverse direction in a reverse driven condition;

a wheel pump fluidically connected to the wheel hydraulic pump for pumping fluid to the wheel hydraulic motor;

means interposed between the wheel hydraulic motor and the wheel pump for fluidically connecting the wheel hydraulic motor and the wheel pump in a forward driven condition so the wheel hydraulic motor rotatingly drives the output shaft in the forward direction and for fluidically connecting the wheel hydraulic motor and the wheel pump in a reverse driven condition so the wheel hydraulic motor rotatingly drives the output shaft in the reverse direction; and means connecting the wheel hydraulic motor output shaft to the wheel shaft for rotatingly driving the wheel shaft and the first and the second wheels in a forward direction when the wheel hydraulic motor output shaft is driven in the forward direction and for rotatingly driving the wheel shaft and the first and the second wheels in a reverse direction when the wheel hydraulic motor output shaft is driven in the reverse direction.

2. The sealant applicator of claim 1 wherein the means for connecting the wheel hydraulic motor output shaft to the wheel shaft is defined further to include:

a first sprocket connected to the wheel shaft;

a second sprocket connected to the output shaft of the wheel hydraulic motor; and a drive chain drivingly connected to the first and the second sprockets.

3. The sealant applicator of claim 1 wherein the mixer pump is defined further as being connected to the second component pump for driving the second component pump, hydraulic fluid being received by the mixer pump and discharged therefrom into the first hydraulic conduit, and wherein the sealant applicator is defined further to include:

a first pump drive connected to the first component pump for driving the first component pump and connected to the fluid reservoir, the first pump drive receiving hydraulic fluid and discharging the received hydraulic fluid into the fluid reservoir.

4. The sealant applicator of claim 3 defined further to include:

a first main pump connected to the fluid reservoir and to the first pump drive and to the mixer pump, the first main pump receiving hydraulic fluid from the fluid reservoir and pumping hydraulic fluid to the mixer pump and the first pump drive; and means for driving the first main pump.

5. The sealant applicator of claim 4 wherein the means for driving the first main pump is defined further as being for driving the wheel pump.

6. The sealant applicator of claim 4 defined further to include:

a flow divider valve interposed between the first main pump and the mixer pump and between the first main pump and the first pump drive, the flow divider valve receiving hydraulic fluid from the first main pump and passing some of the received hydraulic fluid to the mixer pump and passing some of the received hydraulic fluid to the first pump drive.

7. The sealant applicator of claim 1 wherein the means interposed between the wheel hydraulic motor and the wheel pump is defined further to include:

a three position valve having a first position, a second position, and a third position, the valve interrupting fluidic communication between the wheel pump and the wheel hydraulic motor in the first position of the valve, the valve establishing fluidic communication between the wheel pump and the wheel hydraulic motor to condition the wheel hydraulic motor forward driven condition, and the valve establishing fluidic communication between the wheel pump and the wheel hydraulic motor to condition the wheel hydraulic motor in the reverse driven condition in the third position of the valve.

8. A sealant applicator for applying an elastomeric sealant made my mixing a first and a second component, comprising:

a frame;

a first component supply for storing a quantity of the first component being disposed on the frame;

a second component supply for storing a quantity of the second component being disposed on the frame;

a first component pump fluidically connected to the first component supply for receiving the first component and for pumping the first component out a pump discharge;

a second component pump fluidically connected to the second component supply for receiving the second component and for pumping the second component out a pump discharge;

a first component conduit having opposite ends with one end being connected to the pump discharge of the first component pump, the first component pump pumping the first component from the first component supply through the first component conduit;

a second component conduit having opposite ends with one end being connected to the pump discharge of the second component pump, the second component pump pumping the second component from the second component supply through the second component conduit;

a mixer, the end of the first component conduit opposite the end connected to the first component pump being connected to the mixer and the end of the second component conduit opposite the end connected to the second component pump being connected to the mixer, the mixer receiving the first and the second components flowing through the first and the second component conduits and mixing the first and the second components to form the elastomeric sealant when being driven;

a nozzel connected to the mixer for receiving the elastomeric sealant and for dispensing the received elastomeric sealant;

a mixer hydraulic motor connected to the mixer for driving the mixer;

a first hydraulic conduit having opposite ends with one end being connected to the mixer hydraulic motor for delivering hydraulic fluid to the mixer hydraulic motor;

a second hydraulic conduit having opposite ends with one end being connected to the mixer hydraulic motor for receiving the hydraulic fluid from the mixer hydraulic motor, the first and the second component conduits and the first and the second hydraulic conduits each extending a distance from the frame for disposing the mixer, the mixer hydraulic motor and the nozzle at a position remote from the frame;

a fluid reservoir for storing a quantity of hydraulic fluid, the end of the second hydraulic conduit opposite the end connected to the mixer hydraulic motor being connected to the fluid reservoir;

a mixer pump connected to the fluid reservoir and to the end of the first hydraulic conduit opposite the end connected to the mixer hydraulic motor for pumping hydraulic fluid through the first hydraulic conduit to the mixer hydraulic motor; and a flexible tube having an opening extending therethrough, a substantial portion of the first and the second component conduits and the first and second hydraulic conduits extending through the opening in the flexible conduit, the flexible conduit maintaining the first and the second component conduits and the first and the second hydraulic conduits in close proximity during the operation of the sealant applicator so the heat from the first and the second hydraulic conduits heats the first and the second components flowing through the first and the second component conduits.

9. The sealant applicator of claim 8 wherein the mixer pump is defined further as being connected to the second component pump for driving the second component pump, hydraulic fluid being received by the mixer pump and discharged therefrom into the first hydraulic conduit, and wherein the sealant applicator is defined further to include:

a first pump drive connected to the first component pump for driving the first component pump and connected to the fluid reservoir, the first pump drive receiving hydraulic fluid and discharging the received hydraulic fluid into the fluid reservoir.

10. The sealant applicator of claim 9 defined further to include:

a first main pump connected to the fluid reservoir and to the first pump drive and to the mixer pump, the first main pump receiving hydraulic fluid from the fluid reservoir and pumping hydraulic fluid to the mixer pump and the first pump drive; and means for driving the first main pump.

11. The sealant applicator of claim 10 defined further to include:

a flow divider valve interposed between the first main pump and the mixer pump and between the first main pump and the first pump drive, the flow divider valve receiving hydraulic fluid from the first main pump and passing some of the received hydraulic fluid to the mixer pump and passing some of the received hydraulic fluid to the first pump drive.

12. A sealant applicator for applying an elastomeric sealant made by mixing a first and a second component, comprising:

a frame;

a first component supply for storing a quantity of the first component being disposed on the frame;

a second component supply for storing a quantity of the second component being disposed on the frame;

a first component pump fluidically connected to the first component supply for receiving the first component and for pumping the first component out a pump discharge;

a second component pump fluidically connected to the second component supply for receiving the second component and for pumping the second component out a pump discharge;

a first component conduit having opposite ends with one end being connected to the pump discharge of the first component pump, the first component pump pumping the first component from the first component supply through the first component conduit;

a second component conduit having opposite ends with one end being connected to the pump discharge of the second component pump, the second component pump pumping the second component from the second component supply through the second component conduit;

a mixer, the end of the first component conduit opposite the end connected to the first component pump being connected to the mixer and the end of the second component conduit opposite the end connected to the second component pump being connected to the mixer, the mixer receiving the first and the second components flowing through the first and the second component conduits and mixing the first and the second components to form the elastomeric sealant when being driven;

a nozzle connected to the mixer for receiving the elastomeric sealant and for dispensing the received elastomeric sealant;

a wheel shaft, having opposite ends;

means for journally connecting the wheel shaft to the frame;

a first wheel connected to the wheel shaft generally near one end of the wheel shaft;

a second wheel connected to the wheel shaft generally near one of the wheel shaft;

a wheel hydraulic motor supported on the frame having an output shaft, the wheel hydraulic motor rotatingly driving the output shaft in a forward direction in forward driven condition and rotatingly driving the output in a reverse direction in a reverse driven condition;

a wheel pump fluidically connected to the wheel hydraulic pump for pumping fluid to the wheel hydraulic motor;

means interposed between the wheel hydraulic motor and the wheel pump for fluidically connecting the wheel hydraulic motor and the wheel pump in a forward driven condition so the wheel hydraulic motor rotatingly drives the output shaft in the forward direction and for fluidically connecting the wheel hydraulic motor and the wheel pump in a reverse driven condition so the wheel hydraulic motor rotatingly drives the output shaft in the reverse direction; and means connecting the wheel hydraulic motor output shaft to the wheel shaft for rotatingly driving the wheel shaft and the first and the second wheels in a forward direction when the wheel hydraulic motor output shaft is driven in the forward direction and for rotatingly driving the wheel shaft and the first and the second wheels in a reverse direction when the wheel hydraulic motor output shaft is driven in the reverse direction.

13. The sealant applicator of claim 12 wherein the means for connecting the wheel hydraulic motor output shaft to the wheel shaft is defined further to include:

a first sprocket connected to the wheel shaft;

a second sprocket connected to the output shaft of the wheel hydraulic motor; and a drive chain drivingly connected to the first and the second sprockets.

14. The sealant applicator of claim 12 wherein the means interposed between the wheel hydraulic motor and the wheel pump is defined further to include:

a three position valve having a first position, a second position, and a third position, the valve interrupting fluidic communication between the wheel pump and the wheel hydraulic motor in the first position of the valve, the valve establishing fluidic communication between the wheel pump and the wheel hydraulic motor to condition the wheel hydraulic motor forward driven condition, and the valve establishing fluidic communication between the wheel pump and the wheel hydraulic motor to condition the wheel hydraulic motor in the reverse driven condition in the third position of the valve.

* * * * *